United States Patent [19]

Amburn

[11] Patent Number: 4,546,563

[45] Date of Patent: Oct. 15, 1985

[54] METHOD AND APPARATUS FOR KILLING EARTH-BURROWING INSECTS

[76] Inventor: Raymond D. Amburn, 8325 Riverland Dr., Riverland Apartment, Bldg. 6 #1, Sterling Heights, Mich. 48078

[21] Appl. No.: 582,164

[22] Filed: Feb. 27, 1984

Related U.S. Application Data

[63] Continuation-in-part of Ser. No. 419,653, Sep. 20, 1982, abandoned.

[51] Int. Cl.[4] ..... F41C 27/00; A01M 1/00; A01M 17/00

[52] U.S. Cl. ..... 42/1 R; 43/132.1; 89/1.1

[58] Field of Search ..... 42/1 R, 1 F, 1 G, 1 L, 42/1 TB; 89/1 R, 1 B; 43/84, 124, 132.1, 141

[56] References Cited

U.S. PATENT DOCUMENTS

| | | | |
|---|---|---|---|
| 1,440,333 | 12/1922 | Braunger | 42/1 F |
| 1,503,420 | 7/1924 | Hutton | 42/1 R |
| 1,775,178 | 9/1930 | Von Frantzius | 42/1 G |
| 1,897,992 | 2/1933 | Ailes | 42/1 G |
| 2,269,646 | 1/1942 | Burke | 89/1 B |
| 2,456,812 | 12/1948 | Blacker | 42/1 F |
| 2,729,017 | 1/1956 | Mealey | 43/84 |
| 2,968,811 | 1/1961 | Henning et al. | 42/1 R |
| 3,324,767 | 6/1967 | Alban | 42/1 L |
| 3,664,052 | 5/1972 | Mounier | 42/1 L |
| 4,005,976 | 2/1977 | Rombach et al. | 43/124 X |
| 4,160,336 | 7/1979 | Query et al. | 43/132.1 |

FOREIGN PATENT DOCUMENTS

| | | | |
|---|---|---|---|
| 492504 | 5/1917 | France | 42/1 F |

*Primary Examiner*—Charles T. Jordan

*Attorney, Agent, or Firm*—Reising, Ethington, Barnard, Perry & Milton

[57] ABSTRACT

An apparatus for killing fire ants by means of a concussion explosion within the mound of the ants is disclosed. The apparatus includes an elongated shell containing an explosive powder removably mounted at one end of an elongated barrel by means of a holding mechanism. A firing mechanism, is mounted at the opposite end of the barrel for remotely exploding the shell. The outermost part of the shell is tapered to facilitate movement of the shell and the barrel through a wall of the ant mound prior to exploding the shell.

14 Claims, 6 Drawing Figures

METHOD AND APPARATUS FOR KILLING EARTH-BURROWING INSECTS

The instant application is a continuation-in-part of U.S. Ser. No. 419,653, filed Sept. 20, 1982, now abandoned.

TECHNICAL FIELD

This invention relates to an apparatus for killing insects by concussion explosions and, in particular, an apparatus for killing earth-burrowing insects such as fire ants.

BACKGROUND ART

In the southern portions of the United States, insects such as fire ants are serious pests. They cause serious problems for humans, livestock and farm equipment.

Fire ants, also technically known as solenoposis invicta came to the United States at two different times, first in 1918 and again in the 1930's. At the present time colonies of these fire ants have reached infestation levels.

Fire ants have sharp jaws and also have venom-injecting darts which inflict multiple stings disposed at the end of their tails. Fire ants sting humans and livestock, often times killing the livestock. The sting is potentially dangerous to a human if the person stung is allergic to insect bites. A severe allergic reaction may result in death.

One attempt to exterminate fire ants was to use chemical weapons such as Ferriamide, which is a pesticide. However, such a pesticide is strongly toxic and persists in the environment long after it is used. Furthermore, its active ingredient is suspected of causing cancer.

Other pesticides have been used, but are also suspected of being carcinogenic and have been found in alarming levels in the environment long after their use.

Other attempts to destroy fire ants include burning the ant mounds with gasoline or pouring calcium cyanide dust on the fire ants.

Prior patents disclose various devices for killing burrowing animals such as rodents. For example, the U.S. Patent to Rombach et al No. 4,005,976 discloses a gas-fired apparatus which discharges a mixed gas-air flow through a barrel and into a confined area such as a rodent burrow. An igniter container in the barrrel ignites the gas-air mixture. A control assembly, including gas and ignition controls, enables manual operation. Likewise, the U.S. Patent to De Rose No. 968,320 discloses a device which secretes an explosive liquid into a hole inhabited by a rodent and exploding the same by ignition. In the U.S. Patent to Marlman No. 2,145,488 a trap gun is disclosed which is anchored to a stake by a trigger so that the trap gun will explode when an animal takes the bait.

Other prior United States patents disclose various methods for killing insects. For example, the U.S. Patent to Kenline No. 2,856,725 discloses an insecticide bomb which is adapted for hanging. A snap trigger device is adapted to be manually snapped against a percussion cap to detonate the percussion cap to explode the container and disburse an insecticide charge. Likewise, the U.S. Patent to Rogers No. 954,591 discloses an insecticide bomb for killing leaf-eating insects. The bomb is constructed to explode when it reaches a certain height after being discharged from a gun adapted for such purpose. The U.S. Patent to Smith No. 2,783,760 discloses a method and apparatus for killing insects in products such as tobacco by means of shock waves. An electric current is provided for sparking over an air gap to set up a number of shock waves in the air which destroy insect life in the product.

SUMMARY OF INVENTION

An object of this invention is to provide an apparatus for killing earth-burrowing insects, such as fire ants, by means of an explosive charge positioned at one end of an elongated barrel which is remotely detonated from the opposite end of the barrel after insertion of a charge through a wall of an ant mound.

A further object of the invention is to provide an apparatus for killing fire ants in their mounds without the use of pesticides.

Yet another object of the invention is to provide an apparatus for killing earth-burrowing insects such as fire ants by an explosive charge which explosive charge is itself shaped to be held at one end of an elongated barrel and is also shaped to facilitate insertion of a shell-barrel combination through a side wall of an ant mound and into the space where the fire ants reside and wherein a firing mechanism is included to permit an operator of the apparatus to remotely explode the explosive charge within the ant mound.

FIGURES IN THE DRAWINGS

DETAILED DESCRIPTION OF THE DRAWINGS

Figure 1:
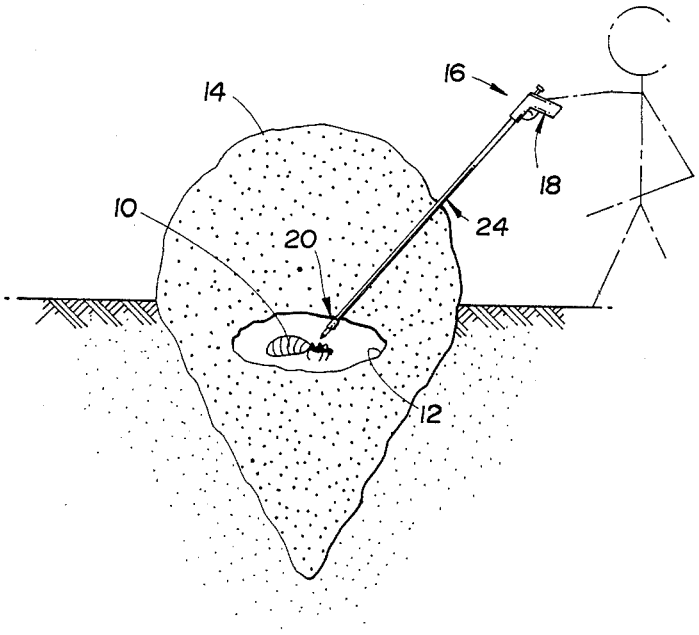
FIG. 1 is a view illustrating the operation of the invention.
Figure 2:
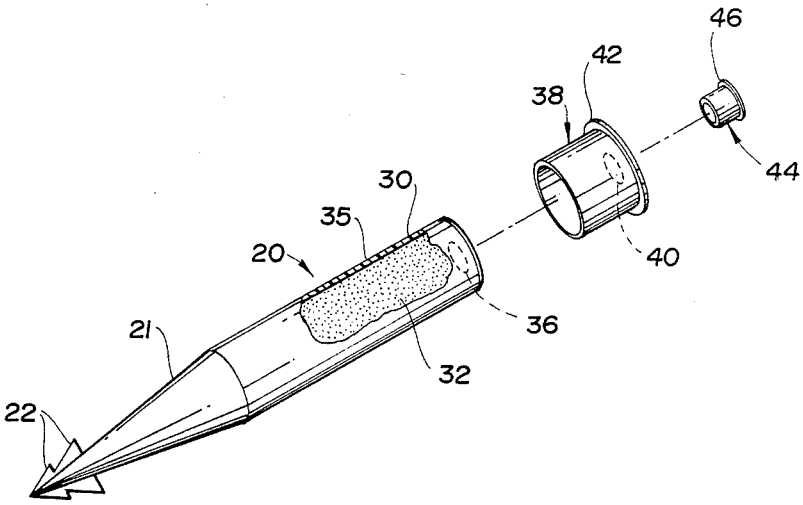
FIG. 2 is an exploded perspective view, partially broken away, of an explosive charge for use in the invention.

Referring to FIG. 1 the apparatus for practicing the present invention is illustrated in its operating environment. In particular, for purposes of illustration, a fire ant 10 is positioned within a cavity 12 within an ant mound 14 constructed by fire ants. The width of such a mound is typically anywhere between one and two feet and the height of such a mound above the ground typically varies between one-half foot to six feet.

The apparatus of the present invention is generally indicated at 16. One end of the apparatus 16 is adapted to be inserted into the cavity 12 and the other end is adapted to be manually operated by a user of the apparatus 16.

The apparatus 16 generally includes at one end thereof a manually operated firing mechanism, generally indicated at 18, the exterior of which is constructed like a pistol. Upon actuation of the firing mechanism 18, an explosive charge or shell, generally indicated at 20, which is mounted at the opposite end of the apparatus 16 is exploded. The explosive charge 20 includes a hollow tapered end portion 21 having barbs 22 integrally formed therewith to permit the operator to push the apparatus 16 into and through a side wall of the mound 14 until the explosive charge 20 enters the cavity 12 of the mound 14 which the operator can feel by the lack of resistance encountered during his pushing of the apparatus through the mound 14.

The apparatus 16 further includes an elongated, hardened-aluminum barrel member, generally indicated at 24, which allows the operator to push the explosive charge 20 through the side wall of the mound 14 and into the cavity 12. The explosive charge 20 is held at one end portion 26 of the barrel member 24 by a hardened-aluminum, hollow, cylindrical holding mechanism, generally indicated at 28.

The charge 20 also includes a hollow cylindrical portion 30 integrally formed with the end portion 21, preferably out of plastic. An explosive powder 32 substantially fills the portions 21 and 30. The explosive powder comprises preferably a powder having the trade name Pyrodex. However, any explosive powder which is relatively hard to ignite in the absence of a primer and which cannot normally be ignited in the ambient may be utilized.

At the end of the cylindrical portion 30 opposite the tapered portion 21 a hole 36 extends therethrough to permit insertion of the explosive powder 32 into the cylindrical portion 30.

The explosive charge 20 also includes a cylindrical metal cap generally indicated at 38 which fits snugly over cylindrical portion 35. The cylindrical cap 38 may comprise an expended cap from a shotgun shell such as a 20-gauge shotgun shell. The cap 38 includes an aperture 40 which extends through an annular top portion 42 of the cap 38. A primer such as a 20-gauge shotgun shell primer, generally indicated at 44, is received and retained within the aperture 40 and is in fluid communication with the explosive powder 32. A top annular portion 46 of the primer 44 engages the top surface of the annular portion 42.

The holding mechanism 28 and the barrel member 24 are releasably held together such as by coacting threads formed on the outer surface of the barrel member 24 and on the inner surface of the holding mechanism 28. Any other suitable mechanism may be provided to allow the explosive charge 20 to be held between the barrel member 24 and the holding mechanism 28 so that the annular portion 42 is gripped therebetween, thereby allowing the cap 38 to be retained within an end portion 48 of the holding mechanism 28.

Figures 3, 4:
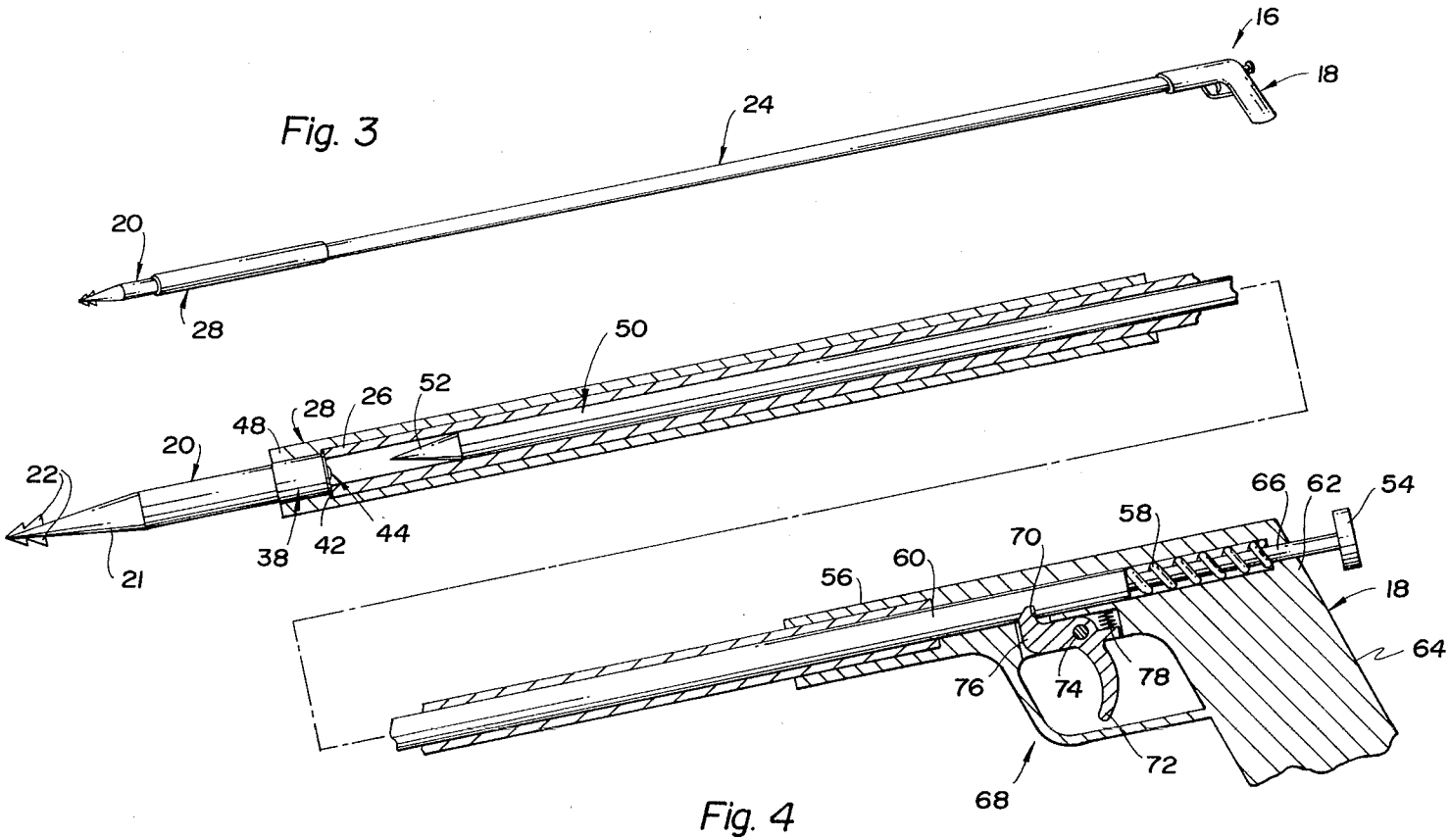
FIG. 3 is a perspective view showing the apparatus of the invention.
FIG. 4 is an enlarged, sectional view of the apparatus of FIG. 3 partially broken away to illustrate the triggering mechanism for use in the invention.

The explosive charge 20 is held at the end portion 26 of the barrel member 24 by the holding mechanism 28 so that the primer 44 is positioned to be impacted by a firing pin, generally indicated at 50 of the firing mechanism 18. A tapered end portion 52 of the firing pin 50 strikes the primer 44 in the fully extended position of the firing pin 50 within barrel member 24. The firing pin 50 is shown in its retracted position away from the primer 44 in FIG. 4. The firing pin 50 is retracted by pulling on a handgrip 54. The end portion 52 of the firing pin 50 may consist of a hardened steel to permit the repeated use of the firing pin 50 to explode a number of explosive charges such as the explosive charge 20.

The end of barrel member 24 opposite the holding mechanism 28 is connected to a barrel portion 56 of the firing mechanism 18 such as by external threads on the outer surface of the barrel member 24 and internal threads on the barrel portion 56.

The firing pin 50 is spring biased by a spring 58 positioned between a cylindrical middle portion 60 of the firing pin 50 and a stop 62 formed on a handle portion 64 of the firing mechanism 18. The spring is positioned about a cylindrical end portion 66 of the firing pin 50 to normally urge the tapered end portion 52 of the firing pin 50 towards the primer 44 of the explosive charge 20.

The firing mechanism 18 includes a trigger mechanism generally indicated at 68 which selectively holds the firing pin 50 in its retracted position and release the firing pin 50 to permit the firing pin 50 to move to its fully extended position, in contact with primer 44. The trigger mechanism 68 includes a flange portion 76 which is adapted to be received within a slot 70 formed in the middle portion 60 to maintain the firing pin 50 in its retracted position. Upon manual actuation of the trigger mechanism 68 at a trigger portion 72, the trigger portion 72 rotates in a counterclockwise direction about a pivot 74 to release the flange portion 76 from the groove 70. A spring 78 of the trigger mechanism 68 normally urges the trigger portion 72 to rotate clockwise about the pivot 74 to urge the flange portion towards the middle portion 60.

After release of the firing pin 50, the spring 58 biases the firing pin 50 to strike the primer 44 to ignite the powder 32. After the charge 20 explodes, the old cap 38 is removed from betwen the holding mechanism 28 and the barrel 24 and a new explosive charge is placed therebetween. The hand grip 54 is again pulled back to permit the flange portion 76 to reenter the groove 70 under the biasing force of the spring 78.

In operation, the apparatus 16 loaded with charge 20 is inserted into the mound 14 until the charge 20 encounters little or no resistance thereby indicating that the charge 20 is disposed in the cavity 12. The firing pin 50 is then retracted and the trigger portion 72 is pulled toward the operator to release the firing pin 50 to impact the primer 46 which ignites the powder 32.

Ignition of the powder 32 causes the charge 20 to explode. The concussion caused by the explosion kills the ants in the cavity 12 including the queen of the ant colony. Thereafter, the apparatus 16 is removed from the mound 14 and the the spent cap 38 is removed by unscrewing the holding mechanism 28. The new charge is placed in the holding mechanism 28 and the barrel 24 is screwed back to the holder mechanism 28.

Figure 5:
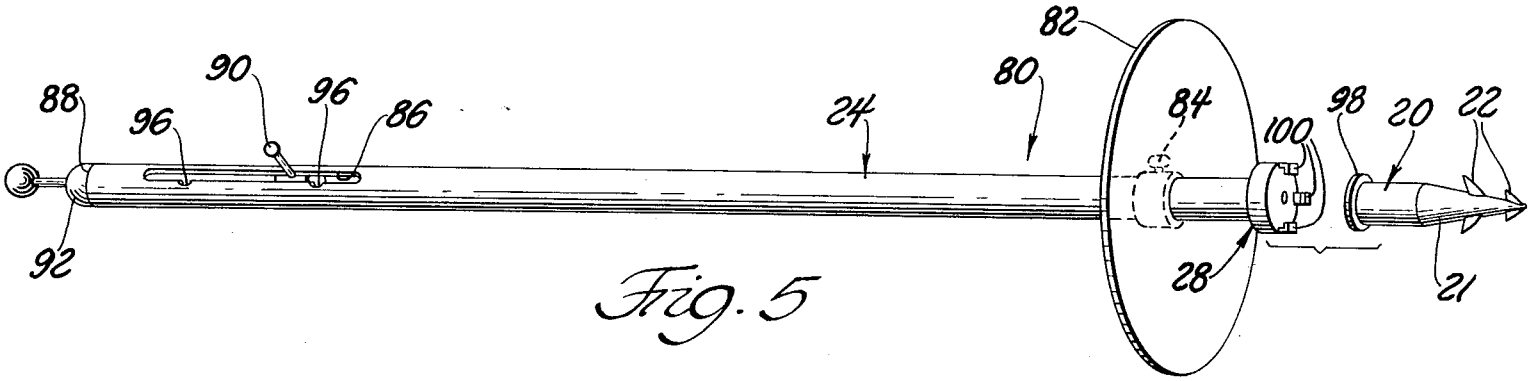
FIG. 5 is a perspective view of another embodiment of the invention.
Figure 6:
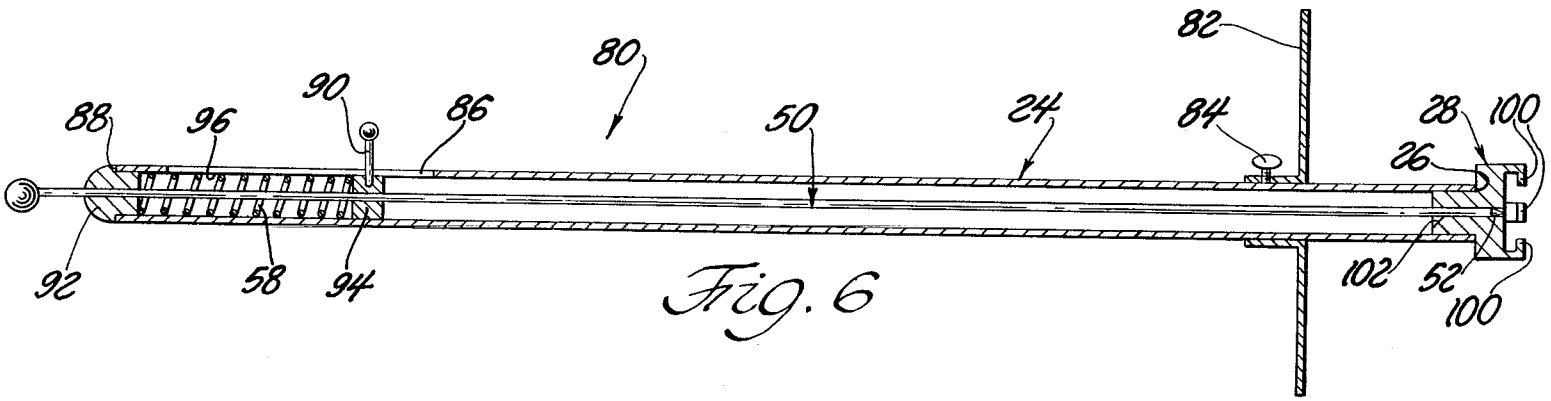
FIG. 6 is a cross sectional view of the embodiment shown in FIG. 5.

Another embodiment is shown in FIGS. 5 and 6. Like numerals are used to designate like structures of the several embodiments.

The apparatus generally indicated at 80 includes shielding means mounted on the barrel 24 for deflecting the exploding material generated during the explosion of the shell 20. The shielding means includes an annular deflecting shield 82 adjustably mounted on the barrel 24 by a set screw 84 for placement along the length of the barrel 24. The shield 82 extends radially outwardly from the barrel 24. In operation, once the shell 20 is forced into the mound the shield 82 can be adjusted along the length of the barrel to deflect any exploding material generated by the explosion of the shell.

The barrel 24 includes a longitudinally extending slot 86 extending from a position spaced from the second end portion 88 of the barrel 24. The firing means includes the firing pin 50 mounted within the barrel 24 for reciprocating movement between the extended and retracted positions at the first end portion 26 of the barrel 24 to impact the shell 20. The firing means further include a lever 90 mounted on the firing pin 50 and extending radially therefrom and through the slot 86 to provide a handle for actuating the firing pin 50. A cap member 92 is mounted over the second end portion 88 of the barrel 24. The firing means further includes a plug member 94 disposed within the barrel 24 and connecting the lever 90 to the firing pin 50. The compression spring 58 is disposed about the firing pin 50 between the plug member 94 and the cap member 92. The apparatus includes locking means including side slots 96 extending transversely from the slot 86 for seating the lever 90 therein thereby locking the lever 90 against the biasing force of the spring 58 to lock the firing pin 50 in the retracted position. The firing pin 50 is released by moving the lever 90 out of the side slot 96 and releasing the lever 90 so that the spring 58 drives the firing pin 50 into the shell 20 as the spring 58 engages the plug 94.

The shell 20 includes a radially outwardly extending flange 98, as shown in FIG. 5. The holding means includes a plurality of prongs 100 for engaging the flange 98 thereby holding the shell 20 against the holding means 28 of the assembly 80.

A wiper 102 is disposed within the barrel 24 proximate to the first end 26 thereof. The firing pin 50 extends through the wiper 102 and is guided thereby as it is moved between the extended and retracted positions.

While a preferred embodiment of the invention has been shown and described herein in detail, those skilled in this art will recognize various alternative designs and embodiments for practicing the present invention as defined by the following claims.

I claim:

1. Apparatus for killing earth-burrowing insects such as fire ants with an explosive shell, said apparatus comprising: a rigid, elongated, hollow barrel having first and second end portions; a hollow shell containing an explosive powder therein; and firing means for selectively exploding the shell, said barrel including holding means for selectively holding one end of said shell at said first end portion of said barrel and for permitting explosion of said shell by the firing mechanism exteriorly of the barrel, said shell including a tapered end end portion for burrowing through an ant mound and a cylindrical container portion having a hole therethrough for receiving the explosive powder.

2. The apparatus as claimed in claim 1 including a primer disposed at the opposite end of said shell in communication with the powder.

3. The apparatus as claimed in claim 2 wherein said firing means includes a manually operated trigger mounted on said second end portion and a firing pin operatively connected to said trigger so as to move between the extended and retracted positions at said first end portion, said firing pin impacting said primer to ignite the powder in the extended position of said firing pin upon actuation of said trigger.

4. The apparatus as claimed in claim 1 wherein said shell includes a cap having an aperture extending therethrough in communication with said hole in said container.

5. The apparatus as claimed in claim 4 including a primer disposed in said aperture, said firing mechanism including a firing pin operatively connected in said barrel to move between extended and retracted positions at said second end portion, said firing pin engaging said primer in the extended position to ignite the powder.

6. The apparatus as claimed in claim 1 including shielding means mounted on said barrel for deflecting the exploding shell.

7. The apparatus as claimed in claim 6 wherein said shielding means includes an annular deflecting shield adjustably mounted on said barrel for placement along the length of said barrel, said shield extending radially outwardly from said barrel.

8. The apparatus as claimed in claim 1 wherein said barrel includes a longitudinally extending slot extending from a position spaced from said second end portion thereof, said firing means including a firing pin mounted within said barrel for reciprocating movement between the extended and retracted positions at said first end portion to impact said shell, said firing means further including a lever mounted on said firing pin and extending radially therefrom and through said slot to provide a handle for actuating said firing pin.

9. The apparatus as claimed in claim 8 including biasing means disposed within said barrel for biasing said firing pin towards said extended position.

10. The apparatus as claimed in claim 9 including a cap member mounted over said second end portion of said barrel, said firing means including a plug member disposed within said barrel and connecting said lever to said firing pin, said biasing means including a compressing spring disposed about said firing pin between said plug member and said cap member.

11. The apparatus as claimed in claim 9 including locking means for locking said firing pin in said retracted position against the biasing force of said biasing means.

12. The apparatus as claimed in claim 11 wherein said locking means includes side slots extending transversely from said first mentioned slot for seating said lever therein.

13. The apparatus as claimed in claim 1 wherein said shell includes a radially outwardly extending flange, said holding means including a plurality of prongs for engaging said flange.

14. The apparatus as claimed in claim 1 including a wiper disposed within said barrel proximate to said first end thereof, said firing means including a firing pin extending through said wiper and being guided thereby.

* * * * *